US007435193B2

(12) United States Patent
Johnson et al.

(10) Patent No.: US 7,435,193 B2
(45) Date of Patent: Oct. 14, 2008

(54) RETRIEVAL DEVICE FOR TETHERED ARTICLES

(76) Inventors: Larry W. Johnson, 25 E. 8th St., Chanute, KS (US) 66720; Lois A. Johnson, 25 E. 8th St., Chanute, KS (US) 66720

( * ) Notice: Subject to any disclaimer, the term of this patent is extended or adjusted under 35 U.S.C. 154(b) by 359 days.

(21) Appl. No.: 11/451,410

(22) Filed: Jun. 13, 2006

(65) Prior Publication Data

US 2007/0026973 A1 Feb. 1, 2007

Related U.S. Application Data

(60) Provisional application No. 60/702,988, filed on Jul. 28, 2005.

(51) Int. Cl.
*A63B 69/00* (2006.01)
*A63B 69/40* (2006.01)

(52) U.S. Cl. ..... 473/423; 473/424

(58) Field of Classification Search ..... 473/423, 473/424, 431, 430, 142, 140, 575, 576; 124/16; 242/387, 386; 254/269; 15/104.33
See application file for complete search history.

(56) References Cited

U.S. PATENT DOCUMENTS

| | | | | | |
|---|---|---|---|---|---|
| 3,051,491 | A | | 8/1962 | Cabot | |
| 3,191,880 | A | * | 6/1965 | Visconti | 242/386 |
| 3,707,268 | A | * | 12/1972 | Kelly | 242/387 |
| 3,735,934 | A | * | 5/1973 | Black | 242/387 |
| 3,826,439 | A | | 7/1974 | Moon | |
| 3,876,162 | A | | 4/1975 | Chun et al. | |
| 4,125,230 | A | * | 11/1978 | Fischer | 242/387 |
| 4,240,592 | A | | 12/1980 | Russo | |
| 4,278,257 | A | * | 7/1981 | Garcia et al. | 473/423 |
| 4,573,687 | A | * | 3/1986 | Nilsson | 473/142 |
| 4,753,442 | A | * | 6/1988 | Bland | 473/424 |
| 5,054,786 | A | | 10/1991 | Solomon | |
| 5,431,404 | A | * | 7/1995 | Kotecki | 473/140 |
| 5,599,238 | A | | 2/1997 | Roderick | |
| 5,772,542 | A | | 6/1998 | Gildea et al. | |

(Continued)

FOREIGN PATENT DOCUMENTS

| | | |
|---|---|---|
| GB | 2154147 | 9/1985 |

(Continued)

*Primary Examiner*—Gene Kim
*Assistant Examiner*—M Chambers
(74) *Attorney, Agent, or Firm*—Richard C. Litman

(57) ABSTRACT

The retrieval device for tethered articles is a portable, compact device well suited for use by solo players practicing various aspects of sports. For example, the device may be used by a football kicker to retrieve a tethered ball after each kick, thereby saving the player considerable time in retrieval efforts and precluding the need for a second person to return the ball. The device may also be used by baseball or softball players for pitching, batting, and/or throwing practice, soccer players, etc. as desired. The device may also be used to retrieve articles other than sports balls. The device includes an electrically powered reel which allows the tether line to pay out with virtually no restriction when the electrical circuit is inactive, but which engages a retrieval reel when activated. Automatic and emergency stop switches are also provided. The device is preferably powered by one or more rechargeable batteries.

18 Claims, 7 Drawing Sheets

U.S. PATENT DOCUMENTS

| | | | |
|---|---|---|---|
| D459,426 | S | 6/2002 | Wang |
| 6,503,150 | B1 | 1/2003 | Holmes |
| 6,796,909 | B2 | 9/2004 | Pribyl |
| 2005/0082409 | A1 | 4/2005 | Jundt et al. |
| 2007/0026973 | A1 * | 2/2007 | Johnson et al. ..... 473/423 |

FOREIGN PATENT DOCUMENTS

| | | |
|---|---|---|
| GB | 2263408 | 7/1993 |

* cited by examiner

RETRIEVAL DEVICE FOR TETHERED ARTICLES

CROSS-REFERENCE TO RELATED APPLICATION

This application claims the benefit of U.S. Provisional Patent Application Ser. No. 60/702,988, filed Jul. 28, 2005.

BACKGROUND OF THE INVENTION

1. Field of the Invention

The present invention relates generally to reels and line dispensing and rewinding devices. More specifically, the present retrieval device relates to a retrieval device for tethered articles that is particularly well adapted for use by solo players practicing various sports for mechanized retrieval of a ball or other article, e.g., an arrow, having a tether attached thereto.

2. Description of the Related Art

So-called "stick and ball" sports, e.g., baseball and softball, football, soccer, etc., require a certain amount of ball handling skill on the part of participants. Players must be able to throw, pitch, hit, and/or kick the ball with reasonable accuracy, depending upon the specific game. The only real way to develop such skills is through practice, of course. While such activities are all team sports, there are many times when a player is unable to get together with others to practice such activities, and therefore must practice alone. Such solo practice oftentimes results in the player spending much more time retrieving the ball after hitting, kicking, or throwing it than is spent in the actual ball-handling activity itself.

This problem has been recognized by others in the past. Nets and the like are well known for restricting the travel of a kicked football during practice, and similar devices (backstops, targets, etc.) are used for pitching and throwing practice in baseball and softball. A problem with such restraining devices is that they often do not allow the ball to travel through its complete flight path, thereby preventing the player from observing the flight path of the ball and the point at which it comes to rest. This greatly restricts the utility of such devices as training aids, as the player does not receive the necessary feedback.

Still other devices have been developed in the past that allow a tethered ball to be hit, kicked, or thrown, and then retrieved by means of the tether. Many, if not most, such devices have been developed for use by golfers, although they might be adapted for use in retrieving other sports balls as well. A problem with most such devices is the orientation of the reel. If the reel axis is normal, to the path of the line dispersal, i.e., the line pays out generally horizontally from a reel with a vertical axis, then the reel must rotate in order to pay out the line. The inertia of the reel greatly restricts the momentum of the ball, particularly in the case of a relatively light ball, such as a golf ball. Moreover, the retrieval drive systems are generally relatively complex, incorporating belts, gears, and/or other intermediate mechanical components between the motor and the reel. In many cases, such devices have employed spring-actuated motors. Such devices are incapable of storing sufficient energy to provide more than a few retrievals, at best, before requiring rewinding of the spring by the user.

Thus, a retrieval device for tethered articles solving the aforementioned problems is desired.

SUMMARY OF THE INVENTION

The retrieval device for tethered articles is a relatively small and lightweight portable device using an electric motor as the rewinding power. The motor is powered by one or more electrical storage cells or batteries, with the batteries preferably being rechargeable. The axis of the reel assembly is concentric with the rewind motor, thereby permitting direct drive operation and eliminating the need for intermediate mechanical componentry and simplifying the assembly. The rotational axis of the reel is concentric with the direction of the line as it pays out from a stationary spool, thereby allowing the line to be stripped from the spool without need to spin a rotating reel or to unwind from the spool or reel. The present retrieval device has no moving parts whatsoever during the period of line payout or dispersal.

When the line and tethered article are to be retrieved, a single rotating reel is actuated by the motor to rewind the line onto the stationary spool. The reel includes a centrifugally actuated catch or finger, which extends from the reel as it spins up to speed. The catch or finger catches the line as it passes around the circumference of the rotating reel, and rewinds the line back onto the stationary spool for the next use. The present retrieval device also incorporates automatic shutoff and emergency shutoff systems, as well as a resilient extension arm, which absorbs the shock of the returning tethered article when it reaches the retrieval device. The extension arm is removable from the front of the housing for compact storage along the side of the housing when the device is not in use.

These and other features of the present invention will become readily apparent upon further review of the following specification and drawings.

BRIEF-DESCRIPTION OF THE DRAWINGS

Similar reference characters denote corresponding features consistently throughout the attached drawings.

DETAILED DESCRIPTION OF THE PREFERRED EMBODIMENT

The present invention is an electrically powered device for retrieving an article (e.g., sports ball, etc.) tethered thereto. The device is particularly useful in assisting solo players practicing various kicking, throwing, hitting, or other ball-handling skills in various so-called "stick and ball" type sports, as the device retrieves the tethered ball back to the player without need for the player to take the time to chase down the ball and return to the original location to repeat the exercise.

Figure 1:
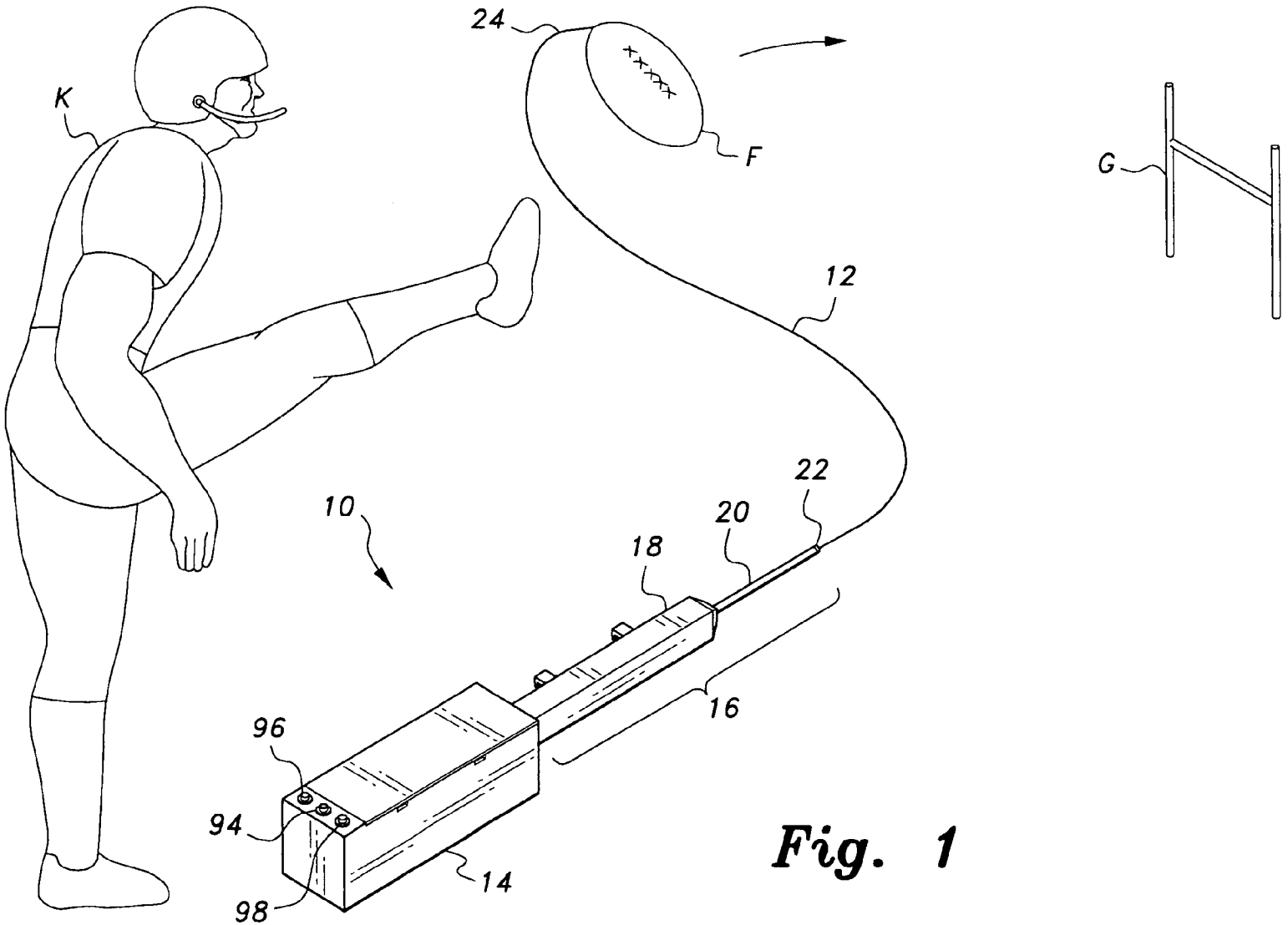
FIG. 1 is an environmental, perspective view of a kicker using the retrieval device for tethered articles according to the present invention.
Figure 2:
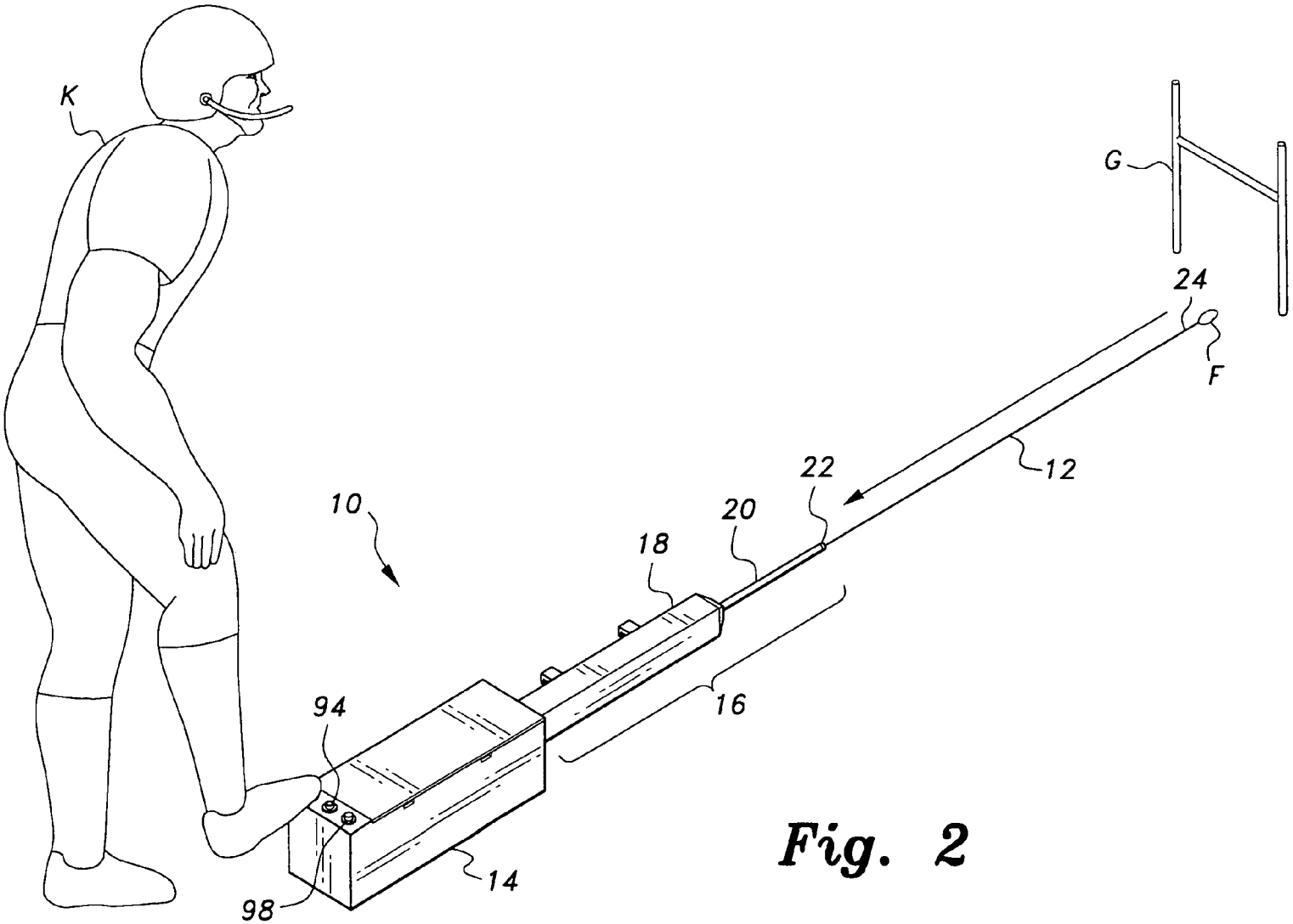
FIG. 2 is an environmental perspective view of the retrieval device in operation, retrieving the tethered article.

FIGS. 1 and 2 illustrate the basic operation of the present retrieval device 10 for tethered articles. In FIG. 1, a sports player, e.g., football kicker K has kicked a football F toward a goal G in solo practice. The structure of the present retrieval device 10 allows the tether line 12 to pay out freely from the device without undue friction or inertia from a rotating reel or spool, thus allowing the football F (or other article) to travel an essentially free path without undue drag or restriction. The result is a travel path that closely approximates free, untethered flight for the tethered article. In FIG. 2 the player or kicker K has activated the return switch (discussed in detail further below) to actuate the rewind motor within the device, thereby rewinding the tether line 12 into the device to draw the football F (or other tethered article) back to the device 10 for the player to repeat the exercise.

Figure 5:
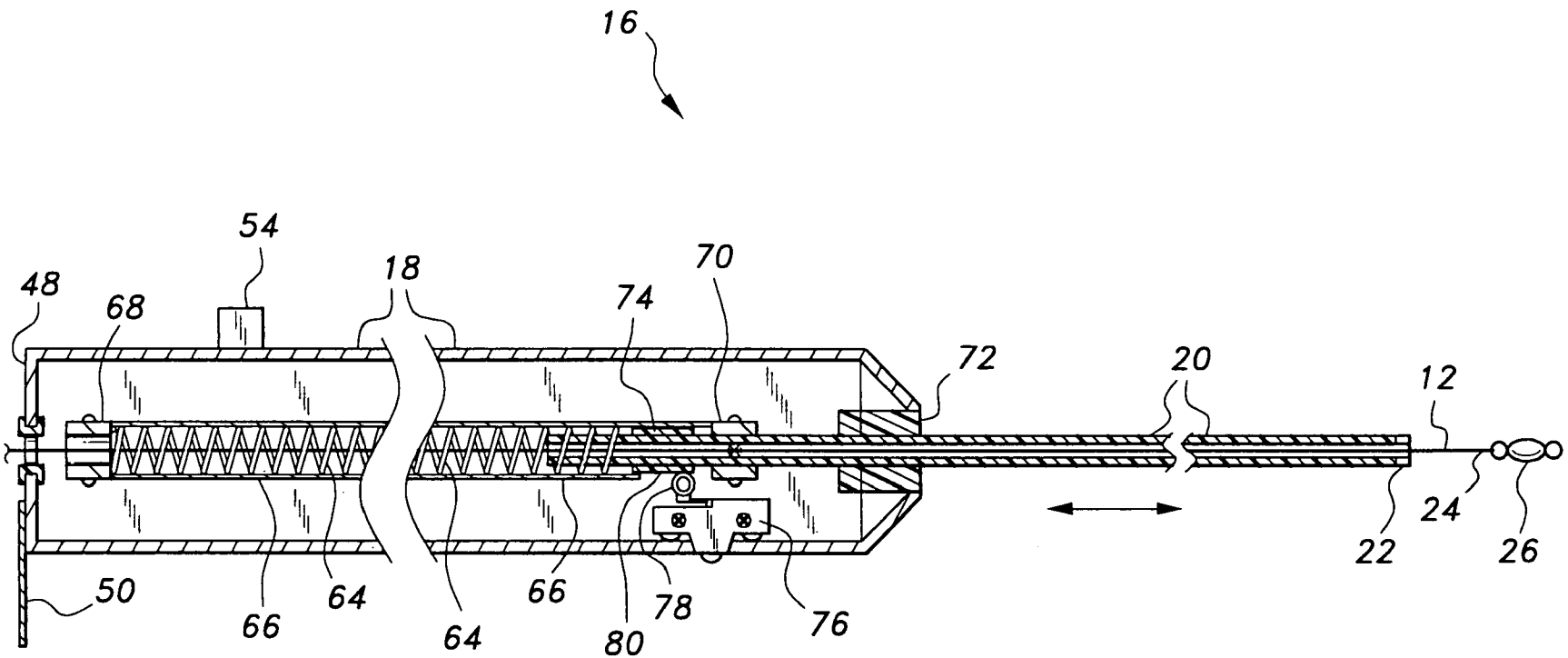
FIG. 5 is a side elevation view in section of the extension component of the retrieval device of the present invention, showing the internal structure thereof.

FIGS. 1 and 2 also illustrate the general configuration of the retrieval device 10. The retrieval device includes a motor and reel assembly housing 14 with an elongate extension tube assembly 16 extending therefrom. The extension tube assembly includes a spring housing portion 18 containing an shock absorbing spring and shutoff switch (shown in FIG. 5 and discussed further below) and a line guide tube 20 telescopically extending from the spring housing 18. The article tether line 12 extends from a guide grommet or sleeve in the distal end 22 of the telescoping guide tube 20, with the distal end 24 of the line 22 being connected to the football F or other tethered article as desired. A swivel 26 may be provided at the distal end of the line 22 to permit the line and tethered article to twist relative to one another, as shown in FIGS. 3 and 5.

Figure 3:
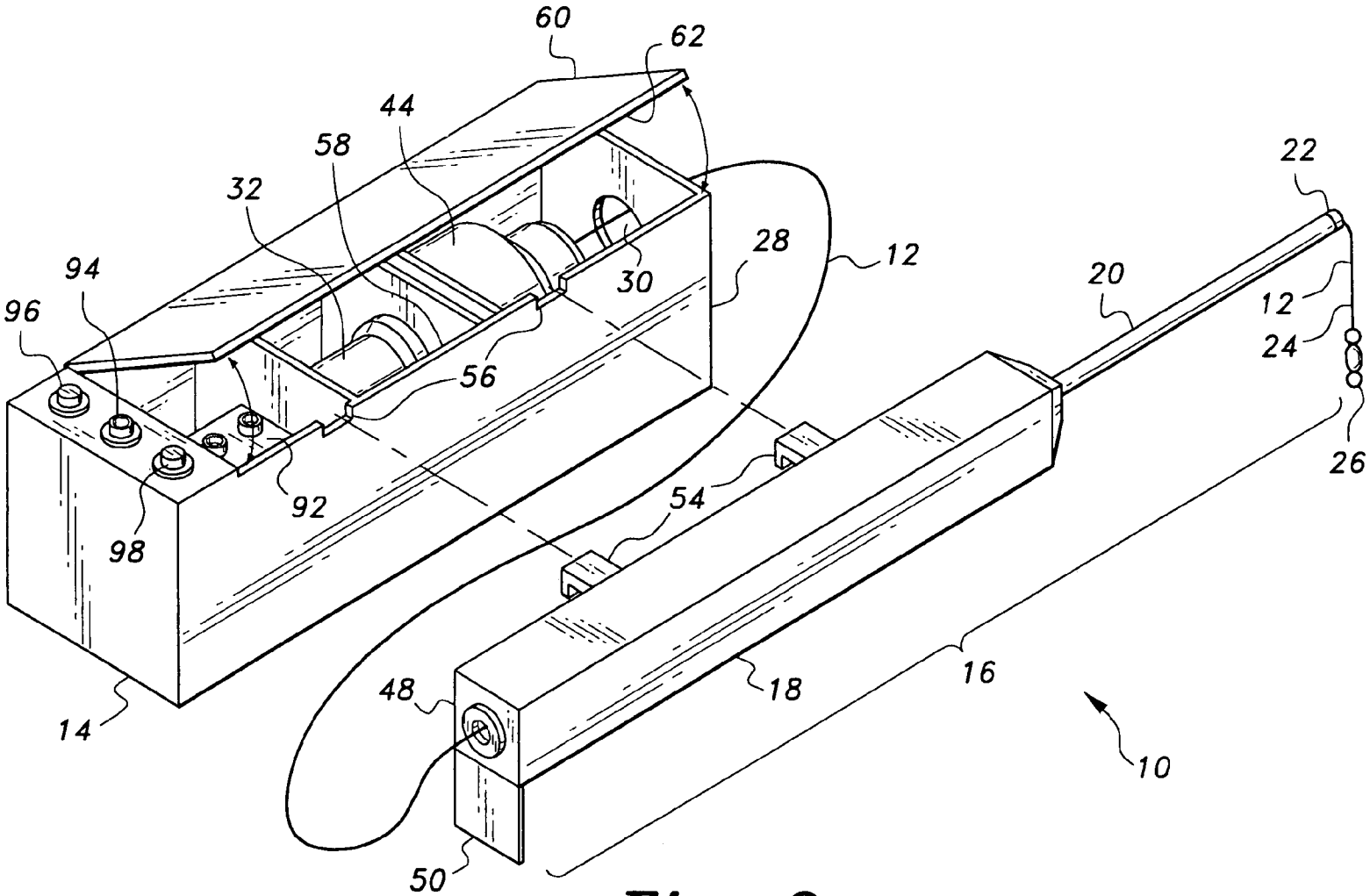
FIG. 3 is an exploded perspective view of the main housing and extension of the retrieval device of the present invention, showing certain internal components within the main housing.
Figure 4:
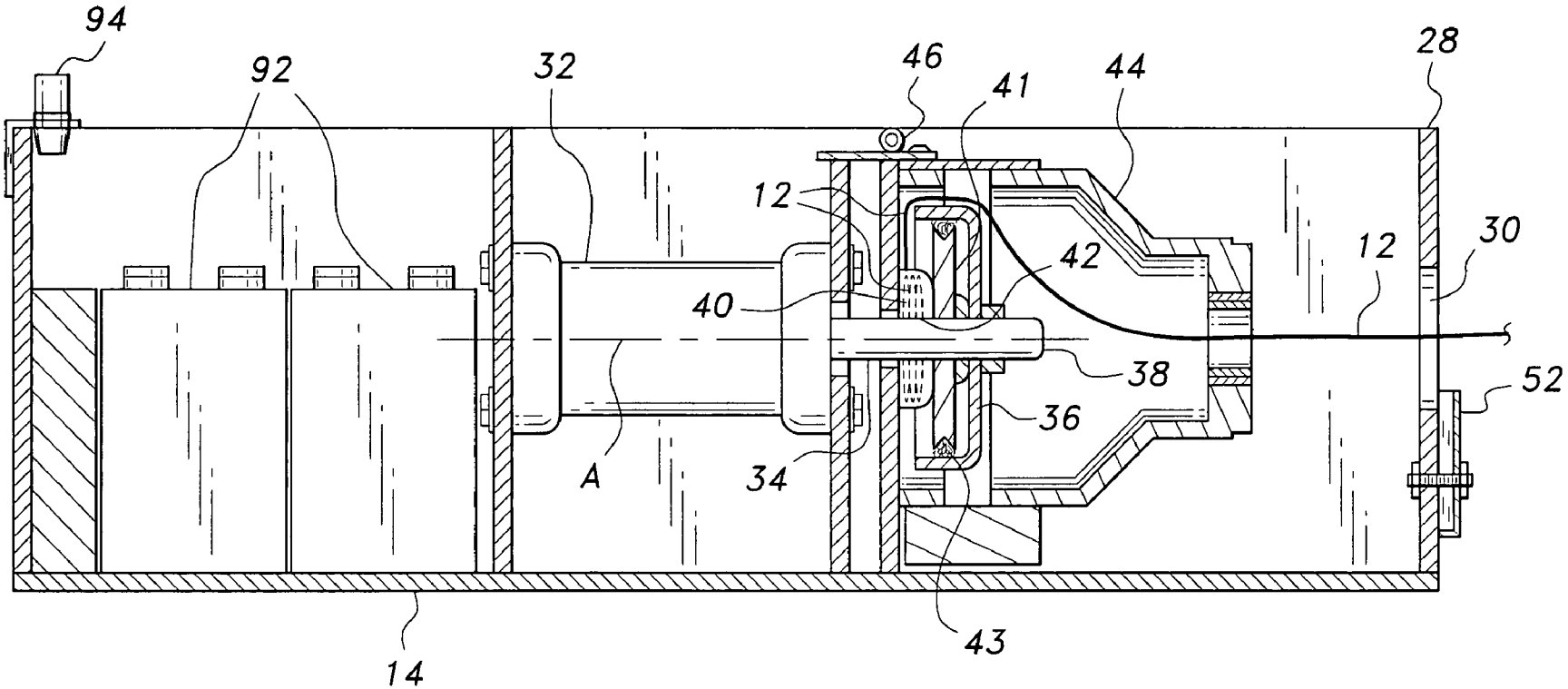
FIG. 4 is a side elevation view in section of the main housing of the retrieval device of the present invention, showing further details of the internal structure thereof.

FIGS. 3 and 4 provide more detailed views of the internal structure of the motor reel and assembly housing 14. The housing 14 of the retrieval device 10 includes a line passage end 28 having a line passage 30 therethrough, with the line 12 extending from the interior of the housing 14 and through the passage 30 and extension tube assembly 16. The interior of the housing 14 includes a take-up reel drive motor 32, which selectively rotates a reel drive shaft 34, which, in turn, drives a rotary reel 36 affixed to the distal end 38 of the shaft 34. The reel drive shaft 34 has a rotary take-up reel 36 fixed onto the shaft for rotation therewith, the reel 36 comprising a flat disc with an upturned peripheral flange, with the flange oriented toward the drive motor 32. The reel 36 includes a mechanism for rewinding the line 12 back on to a stationary spool 40, shown in FIG. 4 and discussed further below.

The stationary spool 40 stores the rewound line 12 thereon when the line is not deployed from the device 10. The stationary spool 40 includes a drive shaft passage 42 therethrough, with the drive shaft 34 passing freely through the drive shaft passage 42 of the spool 40, the stationary spool 40 being disposed between the motor 32 and the rotary reel 36. The stationary spool 40 includes a relatively wide front flange 41 having an outer diameter that fits closely within the inner diameter of the rotating reel flange. A low friction seal 43 may be provided about the periphery of the spool front flange 41 to prevent the line 12 from working between the stationary spool 40 and the rotating reel 36 during line retrieval operation.

The rotating line take-up reel 36 and stationary spool 40 comprise a line spool and line rewind reel assembly. The motor 32 defines a rotary axis A, with the motor 32, drive shaft 34, rotary reel 36, and stationary spool 40 with its drive shaft passage 42 all being concentric to one another about the axis A. The line 12 passes from the stationary spool 40 over or around the peripheral flange of the rotary take-up reel 36, through a generally conical reducer and guide 44, and exits the housing 14 through the line passage 30, whereupon it passes through the extension tube assembly 16 (discussed further below) for attachment to the tethered article. The reducer and guide 44 may be hinged (as shown at hinge 46 in FIG. 4), in order to access the reel and spool assembly for maintenance as needed (e.g., replacement of broken tether line, etc.).

Details of the elongate extension tube assembly 16 are shown in the side elevation view in section of FIG. 5. The extension tube assembly 16 includes a spring housing portion 18 having a motor and reel assembly housing attachment end 48 providing for the removable attachment of the extension tube assembly 16 to the motor and reel assembly housing 14. The attachment end 48 of the spring housing 18 includes an externally depending attachment tab 50, which removably installs within a slotted attachment bracket 52 disposed upon the line passage end 28 of the motor and reel assembly housing 14 (FIG. 4). The tab 50 extending from the spring housing 18 slides into the slot of the attachment bracket 52 of the motor and reel assembly housing 14, to removably secure the extension tube assembly 16 concentrically with the motor and reel assembly housing 14.

The extension tube assembly 16 may be secured laterally to the motor and reel assembly housing 14 for more compact storage, generally as shown in FIG. 3 of the drawings. The spring housing 18 of the extension assembly 16 includes a pair of gripping tabs 54 extending laterally therefrom, which engage a corresponding pair of recesses 56 along the selectively open edge 58 of one wall of the motor and reel assembly housing 14. The housing 14 includes a laterally hinged lid 60, with a capture edge 62 of the lid 60 closing along the selectively open edge 58 of the housing 14. When the lid 60 is closed, it captures the tabs 54 of the spring housing 18 between the capture edge 62 of the lid 60 and immediately adjacent edge 58 of the housing 14, thereby securing the extension tube assembly 16 to the motor and reel assembly housing 14 in a storage configuration. When the lid 60 is opened, the extension tube assembly 16 may be removed and installed on the line passage end 28 of the housing 14 as described further above, with the lid 60 also permitting access to the internal components within the housing 14.

Again referring to FIG. 5, the interior of the spring housing 18 contains an elongate helical compression spring or tethered article shock take-up spring 64, which is contained within a concentric spring guide tube 66. The spring 64 and spring guide tube 66 are anchored within the spring housing 18 at their base ends by a seat 68, with a collar or sleeve 70 located at the opposite end of the spring guide tube 66. The line guide tube 20 passes through an outlet guide 72 in the distal end of the spring housing 18, and through the collar or sleeve 70 of the spring guide tube 66. The internal end of the line guide tube 20 has a line guide tube collar 74 affixed thereto, with the collar 74 bearing against the movable end of the spring 64. Thus, as a sports ball (or other tethered article) is retrieved by the retrieval device 10 and drawn up against the distal end 22 of the line guide tube 20, the tube 20 telescopes rearwardly into the spring guide tube 66 and is resiliently cushioned by the spring 64. This operation cushions any shock imposed by the tethered article as it hits the distal end 22 of the line guide tube 20 at the end of the retrieval operation.

Figure 7:
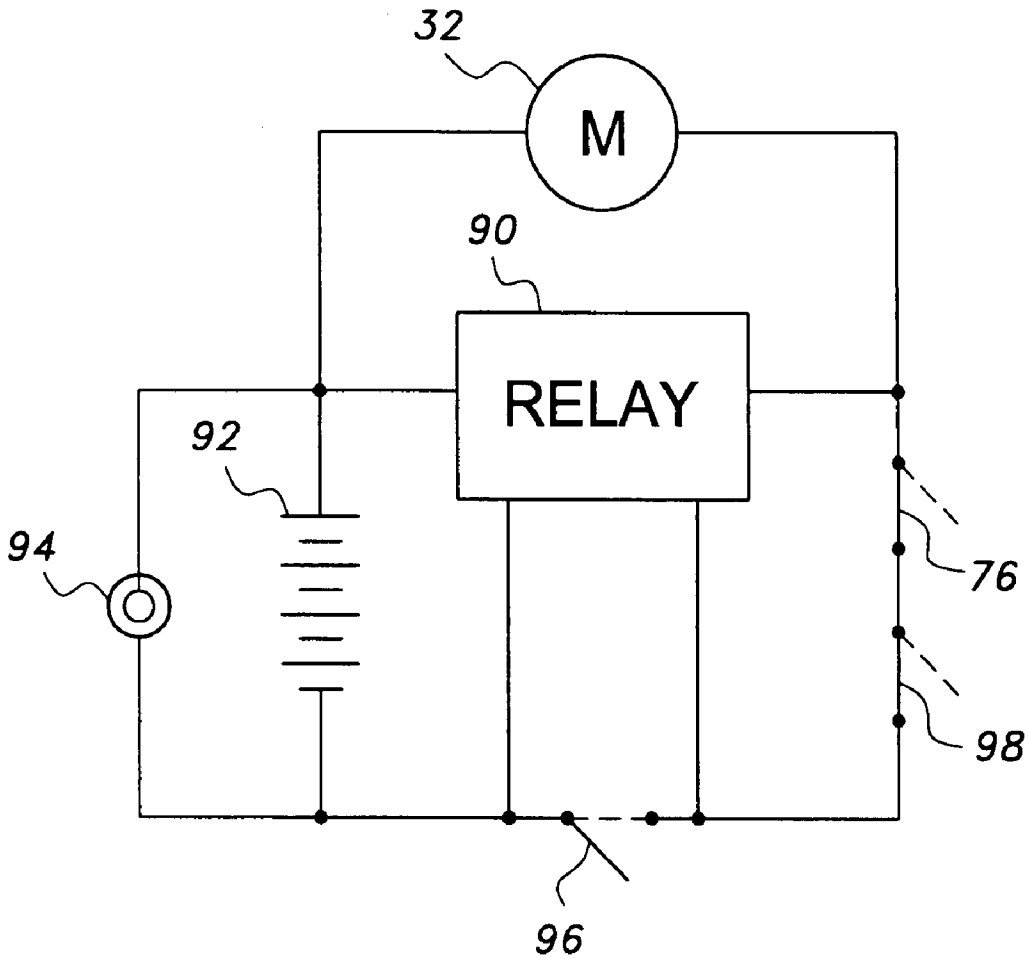
FIG. 7 is an electrical schematic for the retrieval device for tethered articles according to the present invention.

An automatic shutoff switch 76 is installed in the wall of the spring housing 18 with its contact finger 78 normally resting upon the line guide tube collar 74 through a slot 80 formed in the spring guide tube 66 wall. As the line guide 20 is pushed into the spring housing 18 and spring guide tube 66, the collar 74 is also pushed farther into the spring guide tube 66. This allows the contact finger 78 of the automatic shutoff switch 76 to drop or extend past the diameter of the collar 74 down to the underlying wall of the line guide tube 20 as the collar 74 is pushed beyond the switch contact finger 78, thereby opening the shutoff switch 76 to shut off power to the motor 32 within the motor and reel assembly housing 14. The circuitry for this system, as well as other electrical circuitry of the retrieval device 10, is shown in FIG. 7 and discussed further below.

When a sports ball (or other tethered article) is thrown, hit, kicked, etc. away from the retrieval device 10, the retrieval line 12 pays out from the stationary spool 40 by pulling off the end of the spool, around the smooth circumferential flange of the take-up reel 36, and outwardly through the reducer 44 and line passage 30 of the motor and reel assembly housing 14, passing through the spring housing 18 and its line guide tube 20. The stripping of the line 12 from the stationary spool 40 in this manner results in very little friction or drag on the line, with the flight of the tethered article not being appreciably affected by the minimal line drag. Moreover, this is accomplished without need for any electrical power or mechanical movement of any components of the retrieval device 10, other than the extension of the tether line 12.

Figure 6:
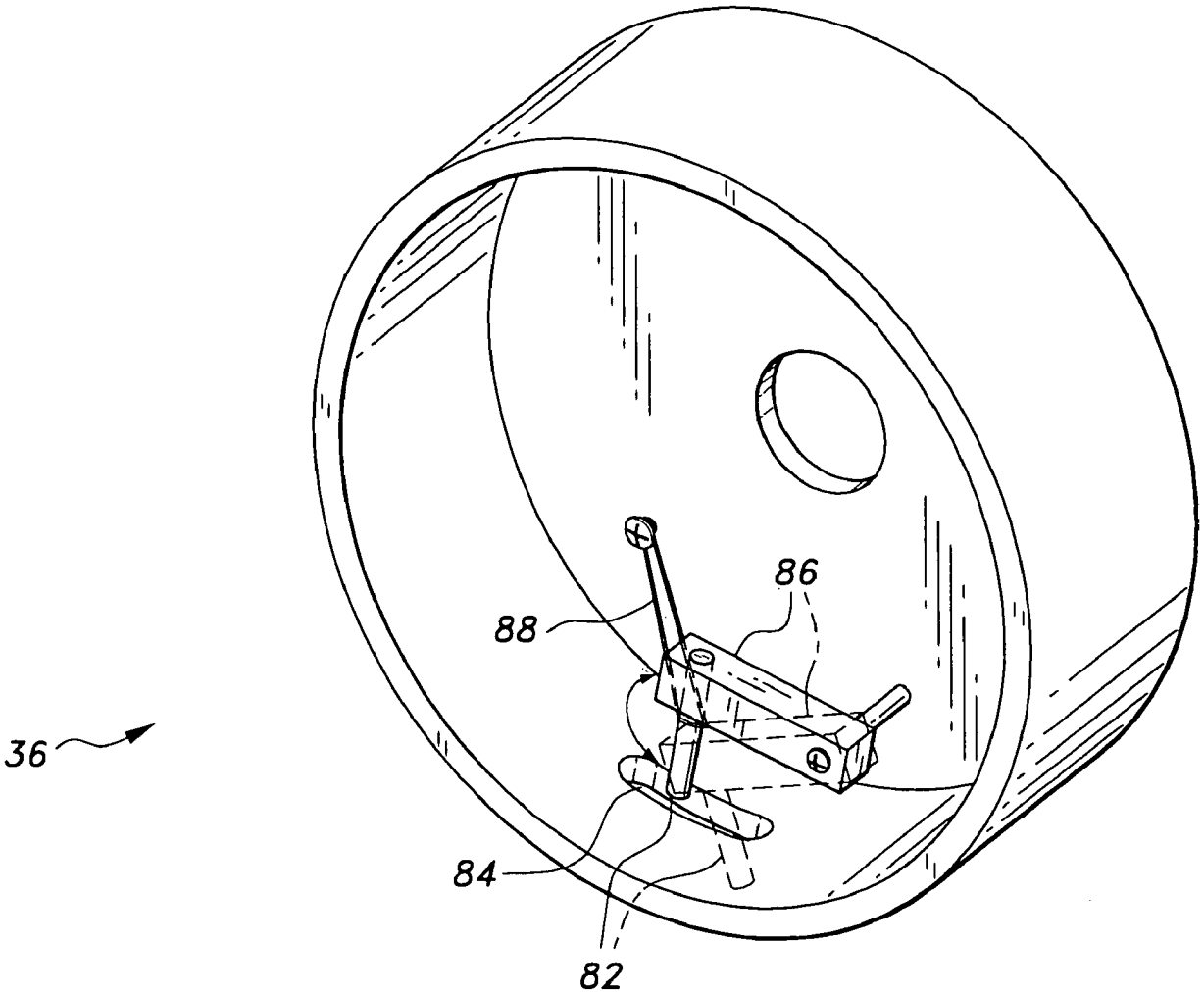
FIG. 6 is a detail perspective view of the rotating line retrieval reel of the retrieval device of the present invention, showing the operation of the centrifugal line retrieval catch.

However, it will be seen that some means of retrieving the line 12 and rewinding it onto the stationary spool 40 is required for operation. This is accomplished by means of the selectively rotating take-up reel 36, which captures the line 12 and rewinds it back onto the stationary spool 40 for retrieval by means of a mechanism shown in FIG. 6. The take-up reel 36 includes a centrifugally actuated line catch finger 82 disposed therein, which extends through a circumferential slot 84 in the flange of the reel 36 when the reel 36 is spun rapidly. The line catch finger 82 extends from a pivotally attached arm or mass 86 within the reel 36, and is normally retained in a retracted position (shown in solid lines in FIG. 6) by a resilient member 88 (e.g., small rubber band, belt, tension spring, etc.).

When the motor 32 is actuated for the retrieval operation, it spins the take-up reel 36 by means of the drive shaft 34. The mass of the pivot arm 86 is thrown radially outward, overcoming the bias of the resilient tension member 88. The line catch finger 82 extends from the slot 84 (as shown in broken lines in FIG. 6) to capture or snag the retrieval line 12, which passes around or over the flange of the reel 36, causing the line 12 to rotate around in unison with the spinning reel 36. As the captured end of the line 12 is anchored to the stationary spool 40, it will be seen that this operation will guide the line to wrap about the spool 40, thus drawing the line 12 back into the motor and reel assembly housing 14 and retrieving the tethered article attached to the distal end 24 of the line 12.

A series of electrical switches, including a start or retrieve switch, an emergency shutoff switch, and the automatic shutoff switch 76 discussed further above, are provided with the retrieval device 10. These switches, as well as the remaining electrical componentry of the retrieval device, are shown schematically in the electrical circuit diagram of FIG. 7. The heart of the circuit is a relay 90, which serves as an interface and switching device between the relatively high amperage demands of the motor 32 and the lower amperages handled by the various switches of the system. The motor 32 is powered by an electrical power source or supply, e.g., an electrical storage battery or batteries 92 which may be enclosed within the motor and reel assembly housing 14. Preferably, the battery or batteries 92 is/are rechargeable. A recharging receptacle 94 may be included in the circuit of FIG. 7, or alternatively a small charger may be installed in the housing 14 and integrated with the circuitry in place of the recharging receptacle 94.

The retrieval operation is actuated by a "start" or retrieve switch 96, which serves to actuate the motor 32. This switch 96 (also shown as one of the pushbuttons in the perspective views of FIGS. 1 and 3) is a normally open switch, which must be physically manipulated to close the circuit and operate the motor 32. This may be accomplished by hand, or with a touch of the toe when the device 10 is resting on the ground, as shown in the retrieve operation illustrated in FIG. 2. The retrieve switch 96 is held to keep the circuit closed until the tethered article completes its return, whereupon the tethered article compresses the line guide tube 20 into the spring guide tube 66 to open the normally closed automatic shutoff switch 76, as described further above.

There may be occasions when the tethered article or the tether line 12 becomes caught or snagged upon some other object, e.g., as the football F passes over the goal post G as shown in FIG. 1. Preferably, the user of the device 10 will note such an imminent problem before it occurs during the retrieve, and actuate the emergency stop switch 98. This stops the motor 32, which allows the centrifugal line catch finger 82 (FIG. 6) to retract into the now stationary rewind spool 36, thereby releasing any strain on the retrieve line 12. The operator of the retrieve device 10 may alternately actuate the retrieve switch 96 and emergency stop switch 98 to alternately apply retrieval tension and slack to the line 12, to work the tethered article and/or its tether line 12 loose from the restraining object.

In conclusion, the present retrieval device greatly facilitates sports practice by solo players in various sports, where the player desires to have repetitious practice in kicking, hitting, pitching, and/or throwing a ball. However, it should be noted that while the present retrieval device has been described as being particularly well suited for use by athletes or players engaged in solo practice with a ball, it should be understood that the present retrieval device is useful in retrieving virtually any form of tethered article, e.g., an arrow shot from a bow. The retrieval device greatly reduces the time otherwise required for the player to retrieve the ball when practicing solo, particularly where no backstop, net, etc. is used to curtail the flight of the ball. Thus, the player may observe the essentially unimpeded, natural flight of the ball and note its flight in order to perfect his or her performance. The relatively rapid retrieval of the ball enables the player to practice the ball-handling action much more frequently than would otherwise be the case if the ball were manually retrieved after each action, thereby further increasing the skills of the player.

It is to be understood that the present invention is not limited to the embodiment described above, but encompasses any and all embodiments within the scope of the following claims.

We claim:

1. A retrieval device for tethered sport articles, comprising:

a motor and reel assembly housing having a line passage end with a line passage defined therethrough;

a selectively operable reel drive motor disposed within the motor and reel assembly housing, the motor having a rotatable shaft;

a portable electrical power supply disposed in the assembly housing, the power supply being electrically to the motor;

a stationary line spool disposed within the motor and reel assembly housing, the spool encircling the shaft;

a line rewind reel assembly disposed on the motor shaft;

an elongate extension tube assembly extending from the line passage end of the motor and reel assembly housing; and a tether line adapted for attachment to a tethered article, the line being disposed on the line spool and passing over the line rewind reel assembly and outwardly from the motor and reel assembly housing through the line passage thereof and through the extension tube assembly, the line rewind reel assembly having means for capturing the tether line and rewinding the line on the stationary spool when the motor is actuated; wherein said extension tube assembly further includes: an elongate spring housing having at least a motor and reel assembly housing attachment end; a tethered article shock take-up spring disposed within said spring housing; and a line guide tube telescopically extending from said spring housing opposite the motor and reel assembly housing attachment end thereof and communicating with said shock spring.

2. The retrieval device for tethered articles according to claim 1, wherein said extension tube assembly further comprises an elongate spring housing having a motor and reel assembly housing attachment end and an externally disposed motor and reel assembly housing attachment bracket, the device further including an extension housing attachment bracket externally disposed upon the line passage end of said motor and reel assembly housing, the motor and reel assembly housing attachment bracket being removably installed within the extension housing attachment bracket.

3. The retrieval device for tethered articles according to claim 1, further including:

at least one gripping tab extending from said spring housing, said motor and reel assembly housing having at least one wall with one edge thereof having at least one gripping tab relief formed therealong; and a motor and reel assembly housing lid having a capture edge selectively closing over the at least one gripping tab relief and removably capturing said at least one gripping tab of said spring housing therein to secure said extension tube assembly to said motor and reel assembly housing.

4. The retrieval device for tethered articles according to claim 1, further including an automatic shutoff switch communicating with and actuated by said line guide tube.

5. The retrieval device for tethered articles according to claim 1, wherein said motor defines a rotary axis, the device further including:

a reel drive shaft extending from said motor and being driven thereby, the drive shaft having a distal reel attachment end opposite said motor;

a line rewind reel affixed to the reel drive shaft and rotating therewith;

a stationary line spool having a reel drive shaft passage therethrough concentrically disposed about the drive shaft between said motor and said reel; and a tether line selectively wound about said line spool and passing about said reel and outwardly from said motor and reel assembly housing through the line passage thereof, the rotary axis of said motor, the drive shaft, and the reel drive shaft passage of said line spool all being concentrically aligned with the line passage of said motor and reel assembly housing.

6. The retrieval device for tethered articles according to claim 5, further including a centrifugally actuated line catch finger disposed within said reel and extending therefrom to capture and rewind said line upon said stationary line spool as said reel is rapidly rotated by said motor.

7. The retrieval device for tethered articles according to claim 1, further including an emergency shutoff switch electrically communicating with said motor.

8. A retrieval device for tethered sport articles, comprising:

a motor and reel assembly housing having a line passage end with a line passage defined therethrough and an externally disposed extension housing attachment bracket;

a selectively operable reel drive motor disposed within said motor and reel assembly housing, the motor having a rotatable shaft;

a portable electrical power supply disposed in the assembly housing, the power supply being electrically to said motor;

a stationary line spool disposed within said motor and reel assembly housing, the spool encircling the shaft;

a line rewind reel assembly disposed on the motor shaft;

an elongate extension tube assembly removably extending from the line passage end of said motor and reel assembly housing, the extension tube assembly having;

an elongate spring housing having a motor and reel assembly housing attachment end and an externally disposed motor and reel assembly housing attachment bracket disposed on the assembly housing attachment end thereof;

a tethered article shock take-up spring disposed within said spring housing; and a line guide tube telescopically extending from said spring housing opposite the motor and reel assembly housing attachment end thereof, and communicating with said shock spring; and a tether line adapted for attachment to a tethered article, the line being disposed on said line spool and passing over the line rewind reel assembly and outwardly from said motor and reel assembly housing through the line passage thereof and through said extension tube assembly, said line rewind reel assembly having means for capturing the tether line and rewinding the line on said stationary spool when said motor is actuated.

9. The retrieval device for tethered articles according to claim 8, further including:

at least one gripping tab extending from said spring housing, said motor and reel assembly housing having at least one wall with one edge thereof having at least one gripping tab relief formed therealong; and a motor and reel assembly housing lid having a capture edge selectively closing over the at least one gripping tab relief and removably capturing said at least one gripping tab of said spring housing therein to secure said extension tube assembly to said motor and reel assembly housing.

10. The retrieval device for tethered articles according to claim 8, further including an automatic shutoff switch communicating with and actuated by said line guide tube.

11. The retrieval device for tethered articles according to claim 8, wherein said motor defines a rotary axis, the device further including:

a reel drive shaft extending from said motor and driven thereby, the drive shaft having a distal reel attachment end opposite said motor;

a line rewind reel affixed to the reel drive shaft and rotating therewith;

a stationary line spool having a reel drive shaft passage therethrough concentrically disposed about the drive shaft between said motor and said reel; and a tether line selectively wound about said line spool, and passing about said reel and outwardly from said motor and reel assembly housing through the line passage thereof, the rotary axis of said motor, the drive shaft, and the reel drive shaft passage of said line spool all being concentrically aligned with the line passage of said motor and reel assembly housing.

12. The retrieval device for tethered articles according to claim 11, further including a centrifugally actuated line catch finger disposed within said reel and extending therefrom to capture and rewind said line upon said stationary line spool as said reel is rapidly rotated by said motor.

13. The retrieval device for tethered articles according to claim 8, further including an emergency shutoff switch electrically communicating with said motor.

14. A retrieval device for tethered sport articles, comprising:

a motor and reel assembly housing having a line passage end with a line passage defined therethrough;

a selectively operable reel drive motor disposed within said motor and reel assembly housing, said motor further having a rotary axis;

a portable electrical power supply disposed in the assembly housing, the power supply being electrically to said motor;

a reel drive shaft extending from said motor and driven thereby, said drive shaft further having a distal reel attachment end opposite said motor;

a line rewind reel affixed to said reel drive shaft, and rotating therewith;

a stationary line spool having a reel drive shaft passage therethrough, the spool being concentrically disposed about said drive shaft between said motor and said reel;

a tether line adapted for attachment to a tethered article, the line being disposed on said line spool and passing over the line rewind reel assembly and outwardly from said motor and reel assembly housing through the line passage thereof and through said extension tube assembly, said line rewind reel having means for capturing the tether line and rewinding the line on said stationary spool when said motor is actuated; wherein said extension tube assembly further includes: a tethered article shock take-up spring disposed within said spring housing; and a line guide tube telescopically extending from said spring housing opposite the motor and reel assembly housing attachment end thereof, and communicating with said shock spring.

15. The retrieval device for tethered articles according to claim 14, further including:

an extension housing attachment bracket externally disposed upon the line passage end of said motor and reel assembly housing; and an extension tube assembly having an elongate spring housing having a motor and reel assembly housing attachment end and an externally disposed motor and reel assembly housing attachment bracket, the motor and reel assembly housing attachment bracket being removably installed within the extension housing attachment bracket.

16. The retrieval device for tethered articles according to claim 15, further including:

at least one gripping tab extending from said spring housing, said motor and reel assembly housing having at least one wall with one edge thereof having at least one gripping tab relief formed therealong; and a motor and reel assembly housing lid having a capture edge selectively closing over the at least one gripping tab relief and removably capturing said at least one gripping tab of said spring housing therein to secure said extension tube assembly to said motor and reel assembly housing.

17. The retrieval device for tethered articles according to claim 15, further including:

an automatic shutoff switch communicating with and actuated by said line guide tube; and an emergency shutoff switch electrically communicating with said motor.

18. The retrieval device for tethered articles according to claim 14, further including a centrifugally actuated line catch finger disposed within said reel and extending therefrom to capture and rewind said line upon said stationary line spool as said reel is rapidly rotated by said motor.

* * * * *